US010160016B1

(12) United States Patent
Bittleston

(10) Patent No.: US 10,160,016 B1
(45) Date of Patent: Dec. 25, 2018

(54) CLEANING SYSTEM FOR AN INTERMEDIATE BULK CONTAINERS

(71) Applicant: Brad Allan Bittleston, Buttonwillow, CA (US)

(72) Inventor: Brad Allan Bittleston, Buttonwillow, CA (US)

( * ) Notice: Subject to any disclaimer, the term of this patent is extended or adjusted under 35 U.S.C. 154(b) by 241 days.

(21) Appl. No.: 14/995,146

(22) Filed: Jan. 13, 2016

Related U.S. Application Data

(60) Provisional application No. 62/103,007, filed on Jan. 13, 2015.

(51) Int. Cl.
*B08B 9/08* (2006.01)

(52) U.S. Cl.
CPC ..... *B08B 9/08* (2013.01)

(58) Field of Classification Search
CPC ..... B08B 9/08
See application file for complete search history.

(56) References Cited

U.S. PATENT DOCUMENTS

2015/0090293 A1* 4/2015 Lewis ..... B08B 9/0826 134/18

* cited by examiner

*Primary Examiner* — Jason Y Ko
(74) *Attorney, Agent, or Firm* — Plager Schack LLP; Mark H. Plager; Michael J. O'Brien

(57) ABSTRACT

A cleaning system can be used on an intermediate bulk container. The cleaning system includes a chemical tank, filled with a chemical liquid. A first chemical pump and a second chemical pump, are mechanically coupled to the chemical tank and configured to pump the contents of the chemical tank. A dispensing valve is mechanically coupled to the first chemical pump and the second chemical pump and configured to dispense the chemical liquid. A water tank, is filled with water. A first water pump and a second water pump are mechanically coupled to the water tank and configured to dispense the water. A topside washing assembly is attached to the chemical tank and mechanically coupled to the first chemical pump and the second chemical pump. The topside washing assembly disperses water from the water tank in order to clean the chemical tank.

8 Claims, 4 Drawing Sheets

CLEANING SYSTEM FOR AN INTERMEDIATE BULK CONTAINERS

RELATED APPLICATION

This application claims priority to provisional patent application U.S. Ser. No. 62/103,007 filed on Jan. 13, 2015, the entire contents of which is herein incorporated by reference.

BACKGROUND

The embodiments herein relate generally to intermediate bulk containers.

Intermediate bulk containers ("IBC") are commonly used by companies to store chemicals and/or liquid products. These chemicals are often hazardous to the health of individuals, which has resulted in a variety of container containment regulations created by the Environment Protection Agency directed toward these concerns. IBC users have a difficult time extracting chemical residues disposed within the container and washing the interior compartment of the container without having risk to themselves or the environment. If the chemical residue stored within the IBC is not washed within a reasonable time, it becomes extremely difficult to clean. Embodiments of the disclosed invention solve this problem.

SUMMARY

A cleaning system can be used on an intermediate bulk container. The cleaning system includes a chemical tank, filled with a chemical liquid. A first chemical pump and a second chemical pump, are mechanically coupled to the chemical tank and configured to pump the contents of the chemical tank. A dispensing valve is mechanically coupled to the first chemical pump and the second chemical pump and configured to dispense the chemical liquid. A water tank, is filled with water. A first water pump and a second water pump are mechanically coupled to the water tank and configured to dispense the water. A topside washing assembly is attached to the chemical tank and mechanically coupled to the first chemical pump and the second chemical pump. The topside washing assembly disperses water from the water tank in order to clean the chemical tank.

In some embodiments, a first tee fitting can be directly attached to the dispensing valve. A first chemical pump first chemical hose can be attached to a first tee fitting and a first chemical pump discharge side on the first chemical pump. A first chemical pump second chemical hose can be attached to a first chemical pump suction side on the first chemical pump and a second tee fitting. A second chemical pump first chemical hose can be attached to the first tee fitting and a second chemical pump discharge side on the second chemical pump. A second chemical pump second chemical hose can be attached to a second chemical pump suction side on the second chemical pump and a third tee fitting. A first transverse hose can be connected to the second tee fitting and the third tee fitting.

In some embodiments, a second chemical pump chemical hose can be connected to the third tee fitting and a first water tank hose with a first water tank hose tee fitting. A first water pump can be attached to the first water tank hose tee fitting at a first water pump suction side on the first water pump. A first water pump discharge hose can be attached to a first water pump discharge side on the first water pump. A fourth tee fitting can be attached to the first water pump discharge hose and a second water pump discharge hose. A second water pump can be attached to the second water pump discharge hose at a second water pump discharge side. A second water pump water tank hose can be attached to the forth pump at a second water pump suction side.

In some embodiments, a water tank can be attached to the first water tank hose and the second water pump water tank hose. A water pump can be attached to the water tank at a water pump discharge side on the water pump. A topside washing assembly can be connected to the water pump with a drain hose. A fourth tee fitting can be attached to the topside washing assembly with a pump hose.

In some embodiments, a plurality of fork lift ports can be within the water tank and configured to fit on forks of a fork lift. A fill valve can be on the water tank and configured to fill the water tank with the water. A plurality of bleed valves can be on the water tank.

In some embodiments, a plurality of chemical tank connectors can be on the water tank. A chemical tank can be connected to the water tank with the plurality of chemical tank connectors. A tank drain can be connected to the chemical tank and further connected to the second tee fitting. The first chemical pump and the second chemical pump can apply head to a chemical fluid in the chemical tank which is then pumped out of the dispensing valve.

In some embodiments, a chemical tank release valve can be opened to allow the chemical fluid to drain from the chemical tank. A topside opening can be configured to fill the chemical tank.

In some embodiments, the topside washing assembly can further include a pump hose connected to a first topside tee joint. A left side hose and a right side hose can be attached to the first topside tee joint. A left side tee joint can be attached to the left side hose, a first displacement hose, and a second displacement hose. A right side tee joint can be attached to the right side hose, a third displacement hose, and a fourth displacement hose. A first spray head can be attached to the first displacement hose. A second spray head can be attached to the second displacement hose. A third spray head can attached to the third displacement hose. A fourth spray head can attached to the fourth displacement hose. A pump hose can be connected to a pressure release valve. The pressure release valve can be connected to a drain hose.

In some embodiments, the topside washing assembly can further comprise a printed circuit board, electrically coupled to the first chemical pump, the second chemical pump, the first water pump, the second water pump, the water pump, a pressure release valve, a battery, and a liquid crystal display. The liquid crystal display can engage the first chemical pump and the second chemical pump to pump a water and chemical mixture through the dispensing valve.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
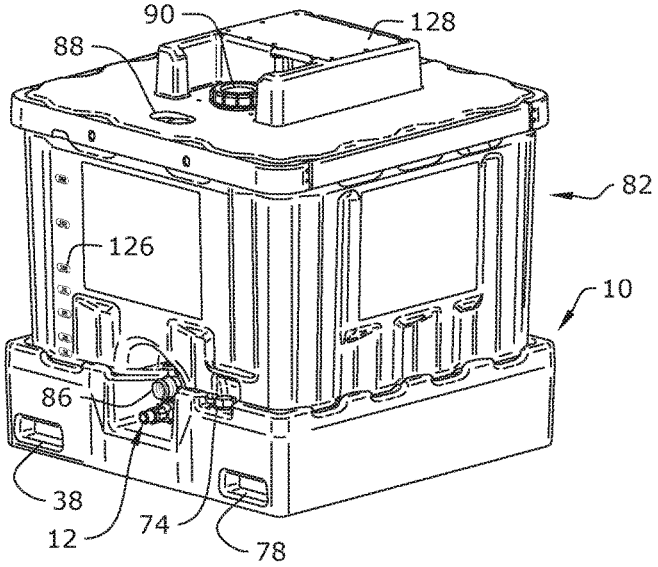
FIG. 1 shows a perspective view of one embodiment of the present invention.
Figure 2:
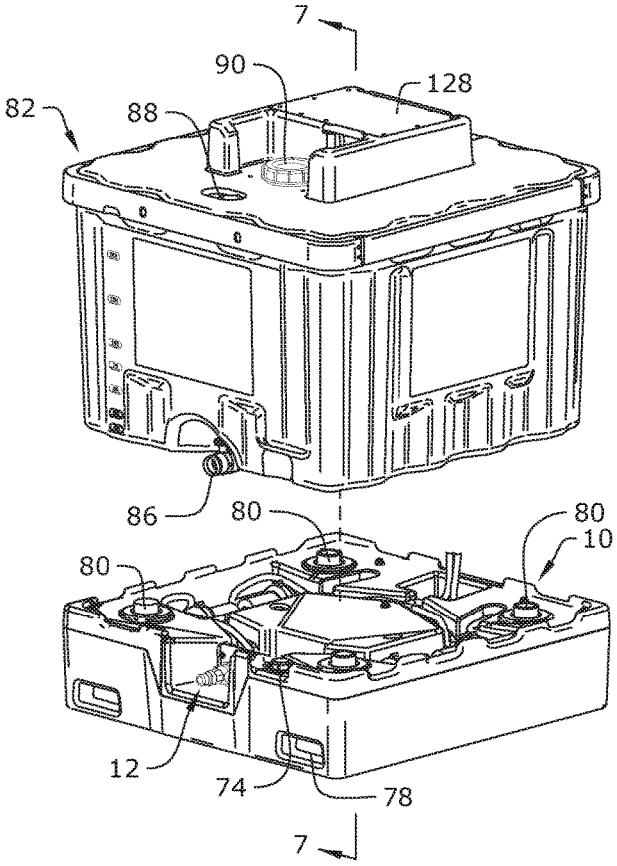
FIG. 2 shows a exploded view of one embodiment of the present invention.
Figure 3:
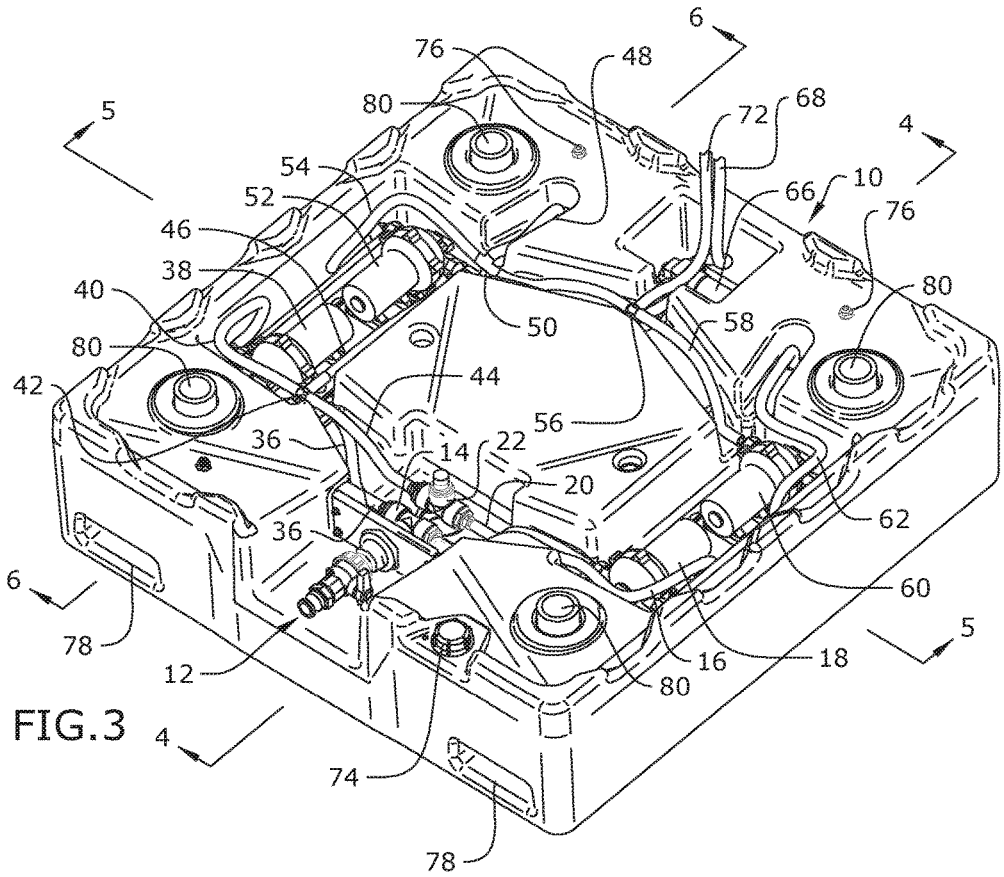
FIG. 3 shows a perspective view of one embodiment of the present invention.
Figure 4:
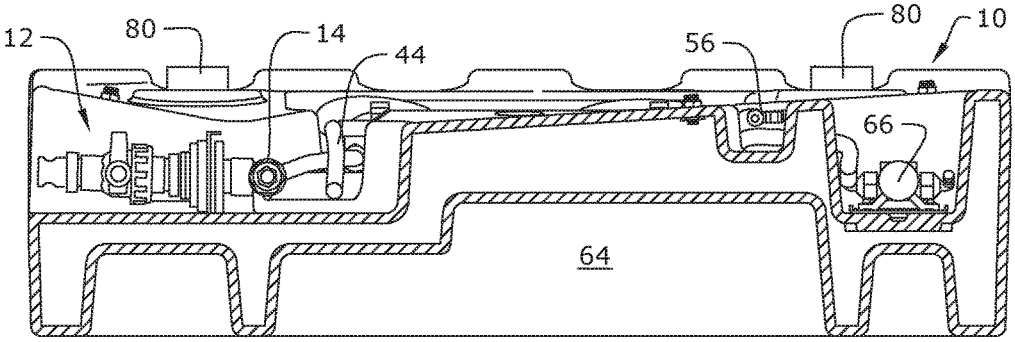
FIG. 4 shows a section detail view of one embodiment of the present invention along line 4-4 in FIG. 3.
Figure 5:
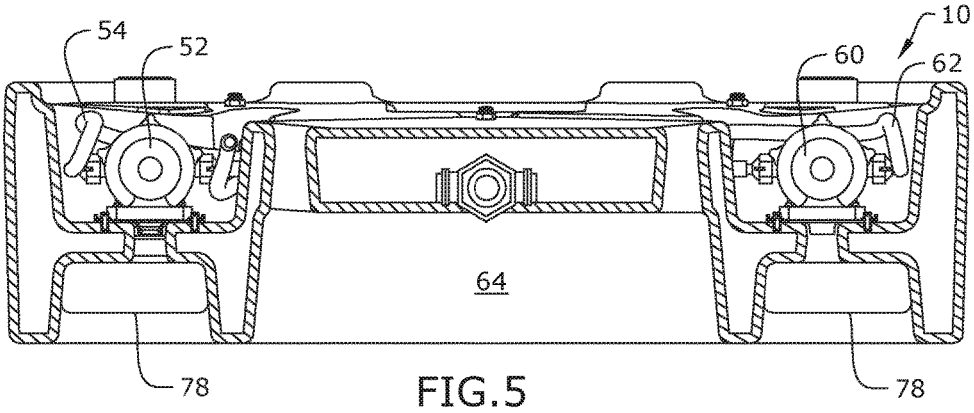
FIG. 5 shows a section detail view of one embodiment of the present invention along line 5-5 in FIG. 3.
Figure 6:
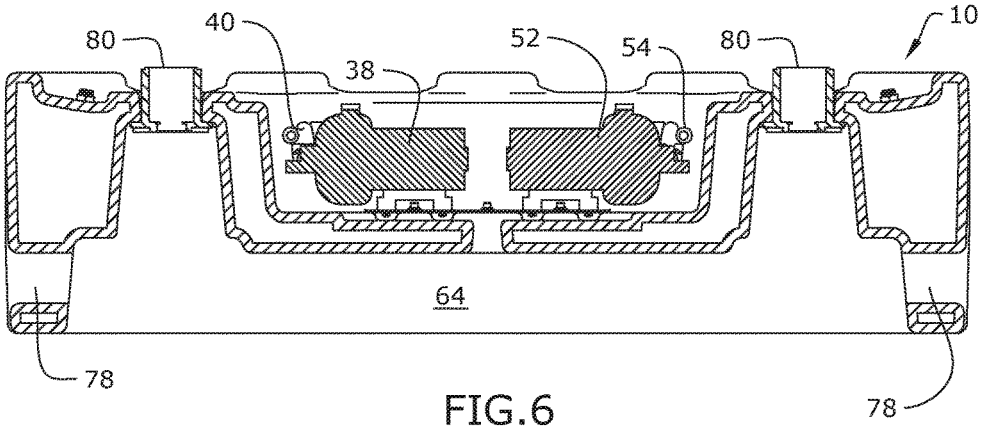
FIG. 6 shows a section detail view of one embodiment of the present invention along line 6-6 in FIG. 3.
Figure 7:
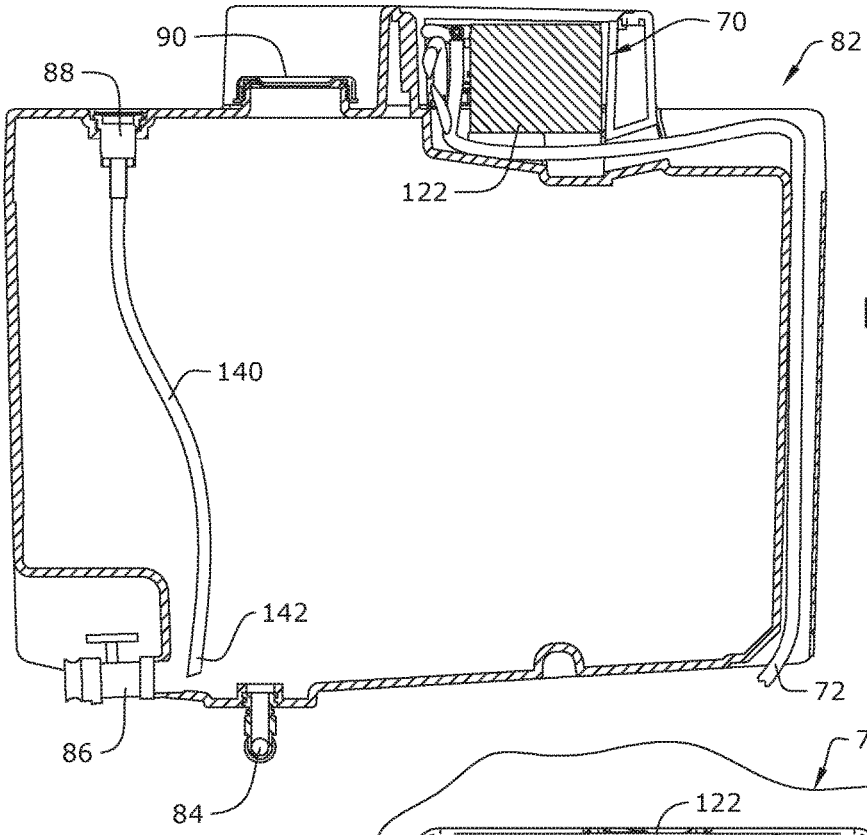
FIG. 7 shows a section detail view of one embodiment of the present invention along line 7-7 in FIG. 3.
Figure 8:
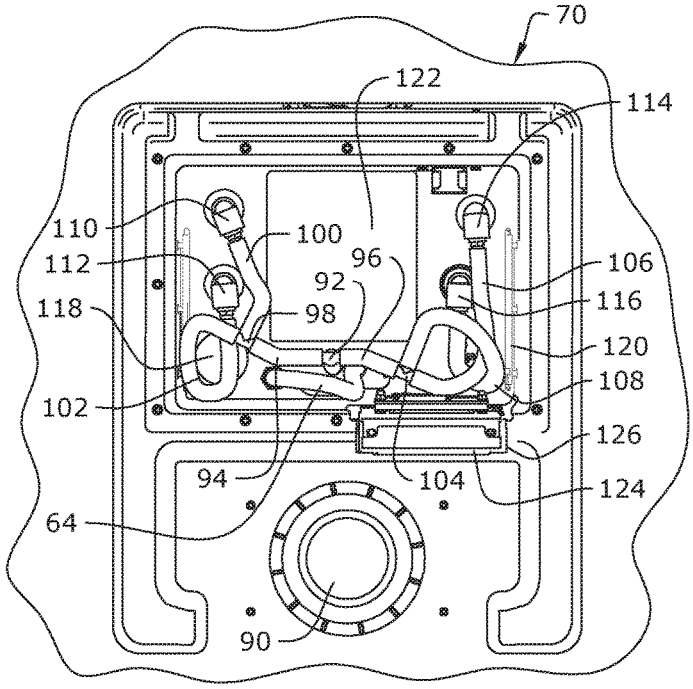
FIG. 8 shows a top view of one embodiment of the present.

By way of example, and referring to FIGS. 1-8, one embodiment of cleaning system 10 comprises dispensing valve 12. Dispensing valve 12 is directly attached to first tee fitting 14. First tee fitting 14 is further attached to first chemical pump first chemical hose 16. First chemical pump first chemical hose 16 is further attached to first chemical pump 18 at a first chemical pump discharge side. First chemical pump 18 is further attached to first chemical pump second chemical hose 20. First chemical pump second chemical hose 20 is attached to second tee fitting 22.

First tee fitting 14 is further attached to second chemical pump first chemical hose 36. Second chemical pump first chemical hose 36 is further attached to second chemical pump 38 at a second chemical pump discharge side. Second chemical pump 38 is further attached to second chemical pump second chemical hose 40. Second chemical pump second chemical hose 40 is attached to third tee fitting 42. Third tee fitting 42 is connected to second tee fitting 22 with first transverse chemical hose 44.

Third tee fitting 42 is further connected to second chemical pump chemical hose 46. Second chemical pump chemical hose 46 is connected to first chemical Agitation pump. First water tank hose is attached to first water pump 52 at a first water pump suction side. The first water pump discharge side is connected to first water pump discharge hose 54. First water pump discharge hose 54 is further connected to fourth tee fitting 56.

Fourth tee fitting 56 is further attached to second water pump discharge hose 58. Second water pump discharge hose 58 is further attached to second water pump 60 at a second water pump discharge side. A second water pump suction side is further connected to second water pump water tank hose 62.

First water tank hose 48 and second water pump water tank hose 62 are connected to water tank 64. Chemical agitation pump 66 is further connected to chemical tank 82 at a chemical agitation pump discharge through port. Chemical agitation pump 66 is through a topside washing assembly 70 via agitation pump hose 68. Fourth tee fitting 56 is further attached to topside washing assembly 70 via pump hose 72.

Water tank 64 further comprises a plurality of fork lift ports 78 configured to fit on the forks of a fork lift. Water tank 64 is attached to fill valve 74, which can be used to fill water tank 64 with water. Water tank 64 has a plurality of bleed valves 76 and a plurality of chemical tank connectors 80.

Chemical tank 82 is connected to water tank 64 with the plurality of chemical tank connectors 80. Chemical tank 82 is connected to tank drain 84. Tank drain 84 is further connected to second tee fitting 22. In one mode of operation, first chemical pump 18 and second chemical pump 38 apply head to chemical fluid in chemical tank 82 which is then pumped out of dispensing valve 12.

Chemical tank 82 further comprises chemical tank release valve 86. In one mode of operation, a user can open chemical tank release valve 86 such that gravity can cause chemical fluid in chemical tank 82 to drain from chemical tank 82.

Chemical tank 82 is further attached to micromatic port 88. This is a valve that is made by Micro Matic® that enables attachment of another pumping mechanism to the valve to pump the chemical fluid. Inside chemical tank 82 and attached to an underside of micromatic port 88 is attached to long tube 140 that extends all the way to a bottom of chemical tank 82. At the bottom of the tube are perforations 142 that let in the chemical fluid so that it can be pumped out from the topside through micromatic port 88. Chemical tank 82 can be filled with chemical fluid from topside opening 90. Chemical tank 82 can further comprise level indicators 126. Level indicators can be a long sensor that extends all the way from a top to the bottom of an inside of the chemical tank 82. It serves as a way to read the level of the chemical remotely and it acts as a safety feature, Meaning that the wash system cannot be engaged until 5 gallons of less of chemical remain in the chemical tank Topside washing assembly 70 is attached to chemical tank 82. Topside washing assembly 70 further comprises pump hose 72 connected to first topside tee joint 92. First topside tee joint 92 is joined to left side hose 94 and right side hose 96. Left side hose 94 is joined to left side tee joint 98. Left side tee joint 98 is further joined to first displacement hose 100 and second displacement hose 102. Right side hose 94 is joined to right side tee joint 104. Right side tee joint 104 is further joined to third displacement hose 106 and fourth displacement hose 108.

First displacement hose 100 is joined to first spray head 110. Second displacement hose 102 is joined to second spray head 112. Third displacement hose 106 is joined to third spray head 114. Fourth displacement hose 108 is joined to fourth spray head 116.

Chemical tank 82 is further connected to pressure release valve 118. Pressure release valve 118 prevents over pressurizing chemical tank 82.

Printed circuit board 120 is electrically coupled to first chemical pump 18, second chemical pump 38, first water pump 52, second water pump 60, water pump 66 and battery 122. Printed circuit board 120 is electrically coupled to liquid crystal display 124. Liquid crystal display 124 is housed in housing 126. Battery 122 can be charged by solar panel 128.

When chemical tank 82 needs to be cleaned. A user can engage liquid crystal display 124 to engage first water pump 52 and second water pump 60 to push water through first spray head 110, second spray head 112, third spray head 114, and fourth spray head 116. This allows water that can be sprayed inside the chemical tank, cleaning/rinsing the interior. Once wash cycle has ended then the rinse water is expelled through the release valve 86. Additionally, a user can engage liquid crystal display 124 to engage first chemical pump 18 and second chemical pump 38 to pump a chemical mixture through dispensing valve 12.

In some embodiments, individual users can log into an operating system in liquid crystal display 124 and receive access to pump a predetermined amount of chemical fluid from dispensing valve 12. This can be done using first chemical pump 18 and second chemical pump 38.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, 6. In particular, any use of"step of" in the claims is not intended to invoke the provision of 35 U.S.C. § 112, 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A cleaning system for an intermediate bulk container wherein the cleaning system is adapted to apply a cleaning solution to an inside of the intermediate bulk container, the cleaning system comprising:

a chemical tank, filled with a chemical liquid;

a first chemical pump and a second chemical pump, mechanically coupled to the chemical tank and configured to pump the contents of the chemical tank;

a dispensing valve, mechanically coupled to the first chemical pump and the second chemical pump and configured to dispense the chemical liquid;

a water tank, filled with water;

a first water pump and a second water pump, mechanically coupled to the water tank and configured to dispense the water;

a topside washing assembly, attached to the chemical tank and mechanically coupled to the first chemical pump and the second chemical pump; and further operatively coupled to the first water pump and the second water pump; wherein the topside washing assembly further comprises:

a pump hose connected to a first topside tee joint;

a left side hose and a right side hose, attached to the first topside tee joint;

a left side tee joint, attached to the left side hose, a first displacement hose, and a second displacement hose;

a right side tee joint, attached to the right side hose, a third displacement hose, and a fourth displacement hose;

a first spray head, attached to the first displacement hose;

a second spray head, attached to the second displacement hose;

a third spray head, attached to the third displacement hose;

a fourth spray head, attached to the fourth displacement hose; and a pump hose, connected to a pressure release valve; wherein the pressure release valve is connected to a drain hose wherein the topside washing assembly disperses water from the water tank through spray heads connected to the topside washing assembly in order to clean the chemical tank.

2. The cleaning system of claim 1, further comprising:

a first tee fitting, directly attached to the dispensing valve;

a first chemical pump first chemical hose, attached to a first tee fitting and a first chemical pump discharge side on the first chemical pump a first chemical pump second chemical hose, attached to a first chemical pump suction side on the first chemical pump and a second tee fitting;

a second chemical pump first chemical hose attached to the first tee fitting and a second chemical pump discharge side on the second chemical pump;

a second chemical pump second chemical hose attached to a second chemical pump suction side on the second chemical pump and a third tee fitting;

a first transverse hose connected to the second tee fitting and the third tee fitting.

3. The cleaning system of claim 2, further comprising:

a second chemical pump water tank hose connected to the third tee fitting and a first water tank hose with a first water tank hose tee fitting;

a first water pump, attached to the first water tank hose tee fitting at a first water pump suction side on the first water pump;

a first water pump discharge hose, attached to a first water pump discharge side on the first water pump;

a fourth tee fitting, attached to the first water pump discharge hose and a second water pump discharge hose;

a second water pump, attached to the second water pump discharge hose at a second water pump discharge side;

a second water pump water tank hose, attached to the forth pump at a second water pump suction side.

4. The cleaning system of claim 3, further comprising:

a water tank, attached to the first water tank hose and the second water pump water tank hose;

a water pump, attached to the water tank at a water pump discharge side on the water pump;

a topside washing assembly, connected to the water pump with a drain hose;

a fourth tee fitting, attached to the topside washing assembly with a pump hose.

5. The cleaning system of claim 4, further comprising:

a plurality of fork lift ports within the water tank and configured to fit on forks of a fork lift;

a fill valve, on the water tank and configured to fill the water tank with water;

a plurality of bleed valves on the water tank.

6. The cleaning system of claim 5, further comprising:

a plurality of chemical tank connectors on the water tank;

a chemical tank, connected to the water tank with the plurality of chemical tank connectors a tank drain, connected to the chemical tank and further connected to the second tee fitting;

wherein the first chemical pump and the second chemical pump apply head to a chemical fluid in the chemical tank which is then pumped out of the dispensing valve.

7. The cleaning system of claim 6, further comprising:

a chemical tank release valve; wherein opening the chemical tank release valve allows the chemical fluid to drain from the chemical tank; and a topside opening, configured to fill the chemical tank.

8. The cleaning system of claim 7, wherein the topside washing assembly further comprises:

a printed circuit board, electrically coupled to the first chemical pump, the second chemical pump, the first water pump, the second water pump, the water pump, a pressure release valve, a battery, and a liquid crystal display;

wherein the liquid crystal display engages the first chemical pump and the second chemical pump to pump a water and chemical mixture through the dispensing valve.

* * * * *